United States Patent [19]

Jones

[11] 4,014,053

[45] Mar. 29, 1977

[54] OFF-SET FLANGE FOR MOUNTING A WATER CLOSET, AND METHOD OF USING SAME

[76] Inventor: Basil B. Jones, Rte. 2, Box 400, Clearwater, Fla. 33515

[22] Filed: June 12, 1975

[21] Appl. No.: 586,161

[52] U.S. Cl. ..... 4/252 R; 285/12

[51] Int. Cl.[2] ..... E03D 11/00

[58] Field of Search ..... 4/252, 253, 68; 285/12

[56] References Cited

UNITED STATES PATENTS

| | | | |
|---|---|---|---|
| 3,263,244 | 8/1966 | Katz | 4/252 R |
| 3,360,805 | 1/1968 | Aumann | 4/252 R |
| 3,457,571 | 7/1969 | Harbake | 4/253 |

*Primary Examiner*—Henry K. Artis
*Attorney, Agent, or Firm*—James B. Middleton

[57] ABSTRACT

An off-set flange for mounting a water closet, the off-set flange comprising an open topped body having a discharge spout for connection of the open topped body to the water closet stub, the body being open so the joint can be caulked all around, and a plurality of covers for the open topped body, each cover being attachable to the body in more than one position to locate an opening in the cover in a selected position to be aligned with the horn of the water closet.

5 Claims, 7 Drawing Figures

OFF-SET FLANGE FOR MOUNTING A WATER CLOSET, AND METHOD OF USING SAME

This invention relates to mounting means for the installation of water closets, and is more particularly concerned with an off-set connection for use as a mounting flange for a water closet.

When a building is constructed, the sewage pipes are installed in a building during construction. Normally, of course, the pipes are placed within the walls and floors of the building so that the sewage pipes must be installed before the building is completed. While the pipes must be installed during the construction of the building, it will be understood that the fixtures such as lavatories, water closets and the like are not installed until the principal construction of the building is completed. Due to this fact, the plumbing for a bathroom, restroom, etc., is stubbed in, which comprises the placing of all pipes required in their proper location, but leaving only a stub to which the fixture can be attached later.

In many buildings, and especially in multi-story buildings, the floors of the buildings are formed by a slab of concrete. In the case of the stub for a water closet, therefore, the pipe is put into place by the plumber, and the concrete floor is poured around the pipe making any change in the pipe a matter of some difficulty. Nevertheless, since a water closet must be accurately placed with respect to a wall, if the water closet stub is not precisely placed, the stub must be moved even though it is very time-consuming and expensive to do so.

In the past, there has been provided an off-set mounting flange for a water closet in an effort to solve the above mentioned problem, but the prior art off-set flange is fixed, so that the degree of off-set is not adapted to the particular problem at hand. Also, the prior art off-set requires that a large hole be provided in the floor surrouding the closet stub in order to set the off-set flange, but the off-set flange itself does not fill the hole, resulting in the expenditure of additional time and effort to fill the remainder of the hole before the floor covering can be installed and the water closet set into place. One of the most difficult problems with the prior art off-set flange, however, is that, due to the very fact of the off-set, a large portion of the joint by which the offset flange is attached to the stub cannot be properly caulked.

The present invention overcomes the above mentioned and other difficulties with the prior art off-set flange by providing an open topped body having a discharge spout for attachment of the body to the water closet stub. The open topped body is of sufficient size to allow the maximum desirable off-set from the discharge spout without restricting the flow of material through the pipe. A plurality of covers is provided for the open topped body, each cover including a mounting flange surrounding an opening for receiving the material into the open topped body. The placement of the opening varies among the plurality of tops to achieve a different amount of off-set from the discharge spout. Additionally, each of the covers can be made reversible so that one cover will provide two different amount of off-set depending on which way the cover is fixed to the open topped body. The mounting flange that surrounds the opening in the cover is such that the water closet mounting bolts can be placed anywhere around the flange for greater versatility in installing the off-set flange of the present invention.

These and other features and advantages of the present invention will become apparent from consideration of the following specification when taken in conjunction with the accompanying drawings in which.

Figure 1:
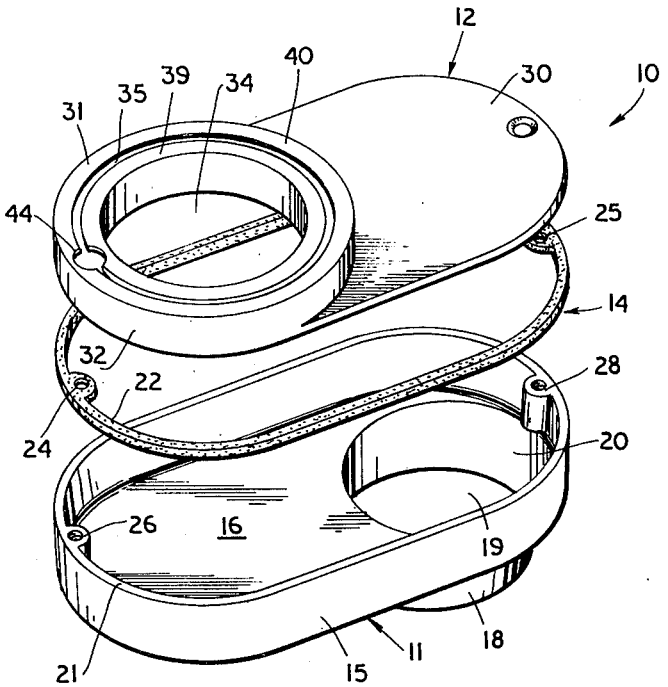
FIG. 1 is a perspective view of one form of off-set flange made in accordance with the present invention, the cover being exploded from the body for purposes of illustration.

Referring now more particularly to the drawings, and to that embodiment of the invention here chosen by way of illustration, the off-set flange 10 shown in FIG. 1 of the drawings comprises an open topped body 11 and a cover 12 therefor, with a gasket 14 for sealing the cover 12 to the body 11.

In more detail, the open topped body 11 includes a generally vertical wall 15 extending up from a sloped bottom 16. As will be discussed in more detail hereinafter, the shape of the bottom 16 and the wall 15 extending therearound is elongated, and somewhat oval in plan view; and, at one end of the oval shape of the body 10, there is a discharge spout 18 having a central opening 19 in communication with the interior 20 of the body 11.

The gasket 14 here illustrated is formed to engage the upper edge 21 of the wall 15 in tongue-and-groove fashion, the upper surface 22 of the gasket 14 being generally flat for engagement by the cover 12. At each end of the gasket 14, there is an enlarged area 24 and 25 to cover a pair of bosses 26 and 28 that are formed integrally with the wall 15; and, the areas 24 and 25 have a hole therethrough to receive a screw. This arrangement will be discussed in more detail below.

The cover 12 shown in FIG. 1 includes a generally flat plate 30 with an elongate shape in plan view corresponding to the shape of the open topped body 11.

At one end of the cover 12, there is a water closet mounting flange 31, here shown as coextensive with the rounded end 32 through the flange 31 may be inward of the end 32 as will be discussed in more detail hereinafter. Centrally of the flange 31 is a hole 34 through which material will be deposited into the body 11. It will be understood by those skilled in the art that the horn of the water closet projects through the hole 34, and water closet bolts are held by the flange 31 to extend through appropriate holes in the water closet to hold the water closet down.

Figure 2:
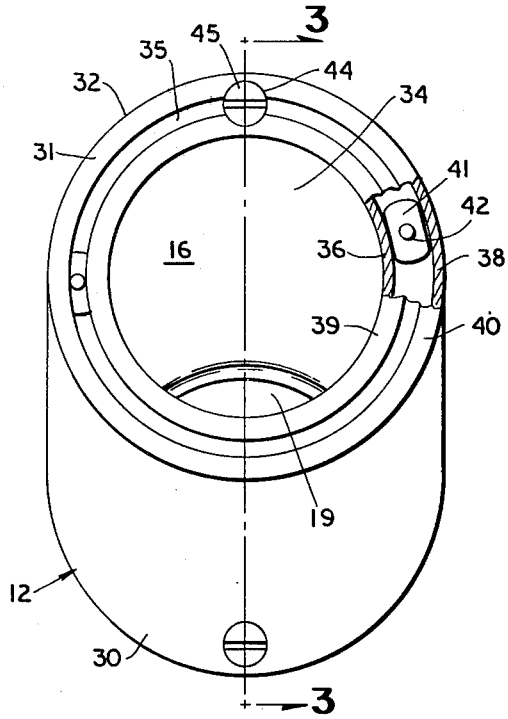
FIG. 2 is a top plan view of the off-set flange shown in FIG. 1.

Referring to FIGS. 1 and 2 of the drawings, it will be seen that the mounting flange 31 is formed as a circular channel 35 defined by opposed concentric ridges 36 and 38. The ridges 36 and 38 have annular flanges 39 and 40 at their upper edges, extending inwardly over the channel 35. Due to this arrangement, it will be seen that the enlarged head 41 of a closet bolt 42 can be received within the channel 35 while the flanges 39 and 40 prevent the head 41 from coming out of the channel 35. Also, the head 41 is conventionally of elongate form, and the ridges 36 and 38 are sufficiently close together that the head 41 will slide between the ridges with the narrow dimension radially of the flange 31, but the head 41 of the bolt 42 cannot rotate between the ridges 36 and 38.

In order to insert the closet bolt 42 into the channel 35, the flanges 39 and 40 are cut away as at 44. The head 41 of the closet bolt 42 can be turned so that its longer dimension is parallel to the channel 35, and the head 41 will slip through the cut out area 44 and into the channel 35.

With the flange 31 at the extreme end of the cover 12 as shown in FIGS. 1 and 2, the cut out 44 serves a dual purpose. As best shown in FIG. 2, a screw 45 for securing the cover 12 to the boss 26 is aligned with the cut out 44 for access to the screw 45.

Figure 3:
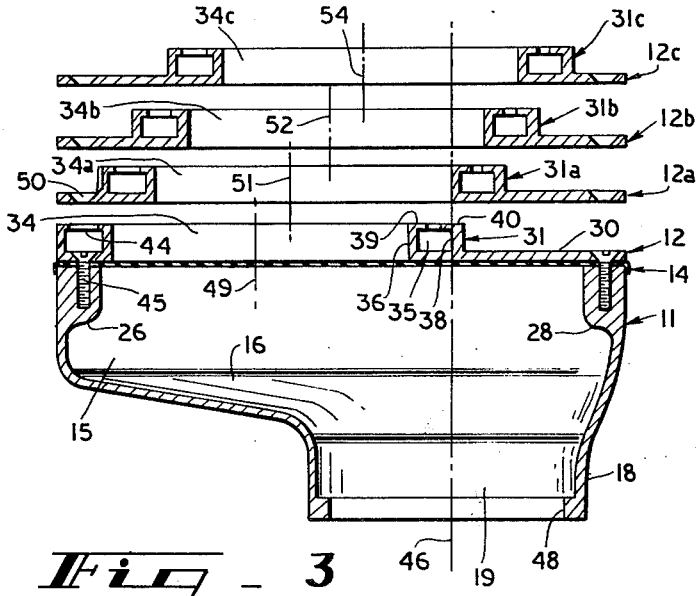
FIG. 3 is a cross-sectional view taken substantially along the line 3—3 in FIG. 2, and including a plurality of alternate covers, also in cross-section, to show the relationship among the several covers here shown; and, FIGS. 4–7 illustrate the sequential steps of installing a water closet using the off-set flange made in accordance with the present invention.

Attention is directed to FIG. 3 of the drawings for a more thorough understanding of the versatility of the device. Here it will be seen that the discharge spout 18 of the body 11 is generally at one end of the body 11, and the discharge spout 18 has the centerline 46. Also, as is best seen in FIG. 3 of the drawings, the discharge spout 18 has the central opening 19, the lowermost edge being formed with a ledge 48. As will be discussed in more detail later, the stub will be inserted into the opening 19 and the ledge 48 will retain the packing for proper caulking of the joint.

Now, the cover 12 is in place on the body 11 with the gasket 14 between as previously described. It will thus be seen that the centerline 49 of the hole 34 is the centerline for mounting a water closet. The distance between the centerline 46 and the centerline 49 is the amount of off-set from the closet stub. Since the mounting flange 31 is at the extreme end of the cover 12 it will be understood that the cover 12 represents the maximum amount of off-set that can be achieved with the apparatus of the present invention.

Looking now at the cover 12A immediately above the cover 12 in FIG. 3, it will be seen that the cover 12A is very similar to the cover 12 except for the placement of the mounting flange 31A and the hole 34A therethrough. Since the flange 31A is not at the extreme end of the cover, there is a hole 50 provided to receive the screw 45, the hole 50 being outside the channel 35 since the hole 50 must remain aligned with the boss 26. Nevertheless, the cut out 44 is still required as an entrance for the closet bolt 42.

It will be seen that the centerline 51 of the cover 12A is slightly closer to the centerline 46 than the centerline 49; thus, the cover 12A represents less off-set than the cover 12.

Since all the covers are substantially alike except for the placement of the mounting flange and the hole therethrough, the description will not be belaboured. Suffice it therefore to point out that the covers 12B and 12C are formed like the covers 12 and 12A but with different placement of the mounting flanges and the holes therethrough, the holes having centerlines 52 and 54 respectively.

From the foregoing description, and as is shown in FIG. 2 of the drawings, the covers 12, 12A, 12B and 12C are symmetrical about their longitudinal centerlines. Because of this, each of the covers can be reversed, end to end for attachment to the body 11, thereby providing a cover with a different amount of off-set. By way of example and not by way of limitation, it has been found that the cover 12 can be so arranged to provide a four inch off-set when placed as pictured in FIG. 3, and to provide a one-half inch off-set when reversed; the cover 12A can provide a three and one-half inch off-set as pictured in FIG. 3, and a one inch off-set when reversed; the cover 12B can provide a three inch off-set and a one and one-half inch off-set; and, the cover 12C can provide a two and one-half and a two inch off-set. Thus, the four covers as here shown by way of example are designed to provide off-sets in one-half inch increments up to four inches. Obviously, other covers can be made to provide other and different amounts of off-set as desired, with each cover providing two different amounts of off-set.

Those skilled in the art should now understand the use of the device of the present invention as described below in conjunction with FIGS. 4–7 of the drawings.

Figure 4:
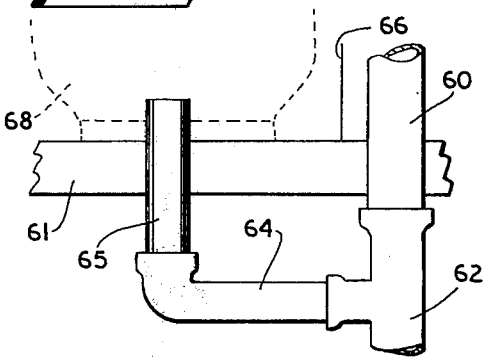

Referring first to FIG. 4, there is a riser 60 passing through a floor 61, and a tee 62 just below the floor 61 provides the connection for the quarter bend 64. The length of the quarter bend 64 determines the placement of the water closet stub 65; and, as shown in FIG. 4 the closet stub 65 is so close to the wall 66 that the water closet 68 cannot be properly installed.

With the conditions shown in FIG. 4, the usual, proper solution is to cut a large hole in the floor 61, remove the closet stub 65 and remove the quarter bend 64; then, replace the quarter bend 64 with one of the proper length, replace the closet stub 65, and patch the hole in the floor 61. One would then be ready to begin to install the water closet. Alternatively, using the off-set flange of the prior art, one must cut a hole in the floor 61, break the closet stub 65 down to the proper height, then attempt to install the flange.

Figure 5:
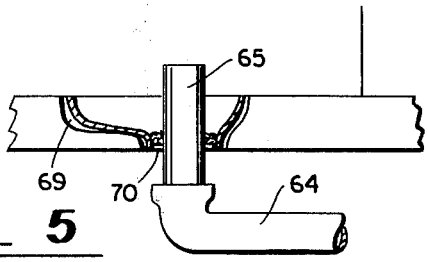
Figure 6:
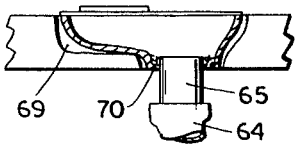
Figure 7:
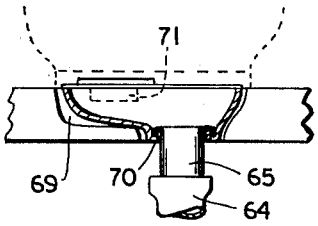

The off-set flange of the present invention is utilized in the circumstances pictured in FIG. 4 by cutting a hole around the closet stub 65 to receive the body 11. As shown in FIG. 5, the hole 69 should conform to the shape of the body 11 as nearly as possible.

In preparing the hole 69, the only determination that must be made is the angular direction of the off-set. For convenience of illustration, the error is shown as being in a direction perpendicular to the wall 66, but the error of placement of the closet stub can be in any direction. In any case, the spout 18 of the body 11 will be substantially centered on the closet stub 65 with the body 11 extending in the direction of the off-set.

Once the hole 69 is prepared, the body 11 is placed into the hole 69 with the closet stub 65 extending through the opening 19 of the body 11. At this point it should be understood that the body 11 can be shifted somewhat with respect to the closet stub 65 to achieve precise placement of the body 11. After the body 11 is placed, it will be seen that the joint 70 can be packed and caulked from above the body 11, the entire circumference being open and unobstructed.

It should now be realized that the joint 70 can be completely caulked before the closet stub 65 is broken down to its final length. As a result, the stub 65 can be broken against the caulked joint 70 for a clean break with no hazard of irregular breaks and split pipes. The person is then ready to place a cover on the body 11.

Now, it must be determined how much off-set is required to place the water closet 68 properly, and a cover, such as the cover 12, will be selected to provide the necessary amount of off-set. As previously described, a gasket 14 will be placed over the upper edge of the body 11, the cover 12 will be placed over the gasket 14, and the cover 12 will be fastened by means of screws 45. It should be noted that the upper surface of the cover 12 is substantially level with the floor 61 so that no further patching or the like is necessary after the device 10 is put into place. Next, closet bolts 42 are placed into the mounting flange 31, and the water closet 68 is put into place with the horn 71 extending through the opening 34.

It should be further understood that, due to the size of the body 11, there is no reduction in cross-sectional area from the horn 71 of the water closet 68, through the body 11, and into the closet stub 65. Furthermore, when the horn 71 is off-set from the closet stub 65 to a relatively large extent, it will be noted that the discharge from the water closet engages the sloped bottom 16 of the body 11, and this will result in a swirling action as the material moves into the closet stub 65. This swirling action will assure that all discharged material will be carried into the closet stub 65, and into the sewer system.

Furthermore, when the horn 71 is so placed that material from the water closet is discharged directly on to joint 70, there will be a significantly large amount of material to fall on the sloped bottom 16 so that there will be a swirling action to assure that all material will be carried into the sewage pipes. Thus, when there might otherwise be a danger of material's hanging on the joint 70, there is sufficient action to assure that all material will flow through the off-set.

It will of course be understood by those skilled in the art that the particular embodiment of the invention here presented is by way of illustration only, and is meant to be in no way restrictive; therefore, numerous changes and modifications may be made and the full use of equivalents resorted to, without departing from the spirit or scope of the invention as defined by the appended claims.

I claim:

1. An off-set flange for mounting a water closet, said off-set flange comprising a body including a bottom, a discharge spout extending from said bottom and having a first centerline, a generally vertical wall extending from said bottom, a cover for said body selectively receivable on the upper edge of said wall, said cover defining an opening therethrough for placing material into said body, said opening having a second centerline, said second centerline being spaced from said first centerline.

2. An off-set flange as claimed in claim 1, and including a mounting flange carried by said cover, said mounting flange being concentric with said opening.

3. An off-set flange as claimed in claim 2, said mounting flange comprising a pair of concentric ridges extending from said cover and defining a continuous channel therebetween, a pair of flanges, one of said pair of flanges being carried by each of said pair of ridges and extending over said channel to define a continuous slot between said flanges, said slot being concentric with said opening.

4. An off-set flange as claimed in claim 3, said body being elongated, said discharge spout being adjacent to one end of said body, said opening in said cover being at one end of said cover, said cover being selectively receivable on said body with said opening adjacent to said one end of said body and adjacent to the opposite end of said body.

5. An off-set flange as claimed in claim 4, and including means for varying the placement of said opening to vary the distance between said first centerline and said second centerline, said means for varying the placement of said opening comprising a plurality of said covers selectively receivable on said body, each of said covers having said opening in a varied location.

* * * * *